US005447040A

United States Patent [19]

Rothstein

[11] Patent Number: 5,447,040

[45] Date of Patent: Sep. 5, 1995

[54] AIR TREATMENT PLANT FOR FOODSTUFF WITH CONVEYOR BELT PERIODICALLY DRIVEN IN OPPOSITE DIRECTION TO THE TROUGHFEED DIRECTION

[75] Inventor: Sven-Olle Rothstein, Angelholm, Sweden

[73] Assignee: Frigoscandia Equipment Aktiebolag, Helsingborg, Sweden

[21] Appl. No.: 211,406

[22] PCT Filed: Oct. 2, 1992

[86] PCT No.: PCT/SE92/00691

§ 371 Date: Apr. 1, 1994

§ 102(e) Date: Apr. 1, 1994

[87] PCT Pub. No.: WO93/07430

PCT Pub. Date: Apr. 15, 1993

[30] Foreign Application Priority Data

Oct. 3, 1991 [SE] Sweden ..... 9102864

[51] Int. Cl.[6] ..... F28G 1/00

[52] U.S. Cl. ..... 62/303; 62/57; 62/380

[58] Field of Search ..... 62/63, 57, 303, 380; 34/164

[56] References Cited

U.S. PATENT DOCUMENTS

| | | | |
|---|---|---|---|
| 2,223,972 | 12/1940 | Sterling . | |
| 3,169,381 | 2/1965 | Persson | 62/57 |
| 3,201,951 | 8/1965 | Robinson . | |
| 3,477,242 | 11/1969 | Lamb et al. | 62/57 |
| 3,528,259 | 9/1970 | Saal | 62/303 |
| 3,601,901 | 8/1971 | Rader | 62/303 |
| 3,612,411 | 10/1971 | Oetjen et al. | 34/164 |
| 3,886,762 | 6/1975 | Rothstein et al. . | |
| 3,982,404 | 9/1976 | Overbye . | |
| 4,173,127 | 9/1979 | Sandberg . | |
| 4,281,521 | 8/1981 | Martin et al. | 62/57 |
| 4,283,923 | 8/1981 | Gruda et al. | 62/303 |
| 5,025,632 | 6/1991 | Spritzer | 62/303 |
| 5,349,828 | 9/1994 | Lee et al. | 62/303 |

FOREIGN PATENT DOCUMENTS

| | | |
|---|---|---|
| 2063184 | 12/1969 | Germany . |
| 2039015 | 7/1980 | United Kingdom . |

*Primary Examiner*—Ronald C. Capossela
*Attorney, Agent, or Firm*—Browdy and Neimark

[57] ABSTRACT

An air treatment plant, e.g. a freezing plant for foodstuffs, comprises a housing (1), an elongate trough (12) provided therein for receiving the foodstuff to be treated, a heat exchanger (13), and a fan assembly (14) for producing an air flow circulating through the heat exchanger, up through the trough and back to the heat exchanger. The bottom of the trough comprises a foraminated conveyor belt (16). The conveyor belt (16) is driven by an electric motor having a control unit for at least periodically driving the conveyor belt in a direction opposite to the throughfeed direction of the foodstuff in the trough (12).

19 Claims, 2 Drawing Sheets

AIR TREATMENT PLANT FOR FOODSTUFF WITH CONVEYOR BELT PERIODICALLY DRIVEN IN OPPOSITE DIRECTION TO THE TROUGHFEED DIRECTION

BACKGROUND OF THE INVENTION

I. Technical Field of the Invention

The present invention generally relates to an air treatment plant for foodstuffs, comprising a housing, an elongate trough provided therein for receiving the foodstuff to be treated, a heat exchanger and a fan assembly for producing an air flow circulating through the heat exchanger, up through the trough and back to the heat exchanger, the bottom of the trough comprising a foraminated conveyor belt.

The invention relates more specifically to a freezing plant, but is also applicable to other air treatment plants, e.g. for cooling, drying and heating. In the freezing plant, the heat exchanger is a cooling-coil battery.

II. Prior Art

In known freezing plants of this type, problems are often met with in that foodstuff particles, or accompanying water, freeze on to the top side of the belt and build up a layer of ice thereon. This ice layer will of course adversely affect the air flow through the conveyor belt and, hence, the agitation or fluidisation of the foodstuff particles in the trough. As a result, the operation of the freezing plant must be stopped more frequently than desirable.

Similar problems of layers of foodstuff or other matter building up on the conveyor belt may also arise in other air treatment plants for foodstuffs.

OBJECT AND SUMMARY OF THE INVENTION

The object of the present invention is to overcome or at least substantially reduce the build-up of such layers on the conveyor belt.

According to the invention, this object is achieved in that the conveyor belt is driven by a motor provided with a control unit for at least periodically driving the conveyor belt in a direction opposite to a throughfeed direction of the foodstuff in the trough.

In the case of a freezing plant, foodstuff particles freeze on to the top side of the belt primarily on the location in the trough where the foodstuff particles are supplied, i.e. in the conveyor belt adjacent the infeed opening. With the inventive arrangement, it is thus possible to readily prevent the build-up of material on the belt, which is achieved more specifically in that the belt, by being driven in a direction opposite to the throughfeed direction of the foodstuff in the trough, is at least periodically moved out into the area before the front end of the trough, where it can be easily relieved of any layer of material that may have built up on it. The control unit may be arranged for periodically driving the belt in opposite directions about a fixed position, i.e. the belt then behaves in almost the same way as a trough which has a fixed bottom, the trough being oscillated in its longitudinal direction. This produces the additional effect which is achieved with such an oscillating trough, i.e. intensified agitation or fluidisation.

Alternatively, the control unit may be arranged for periodically driving the belt in opposite directions with a net motion in the throughfeed direction of the foodstuff in the trough. Thus, the belt contributes to the feed of foodstuffs through the trough.

The most effective removal of layers built up on the conveyor belt is however achieved in that the control unit is arranged for continuously driving the conveyor belt in a direction opposite to the throughfeed direction of the foodstuff in the trough.

In all the cases, the arrangement has a device for removing on the infeed side of the trough layers of material which have built up on the conveyor belt, especially for deicing.

The motor used in the air treatment plant is advantageously a stepping motor.

The bottom of the trough may comprise a fixed, foraminated plate disposed underneath the conveyor belt. Suitably, the bottom of the trough however consists only of a foraminated conveyor belt. In a preferred embodiment, this consists of plates which are articulated to each other and have perforations over their entire surface in the form of through holes, as well as through slots at their portions of articulation.

BRIEF DESCRIPTION OF THE DRAWINGS

The invention, as specifically applied to air treatment plants in the form of freezing plants, will be described in more detail hereinbelow with reference to the accompanying drawings.

DETAILED DESCRIPTION OF THE PREFERRED EMBODIMENT(S)

Figure 1:
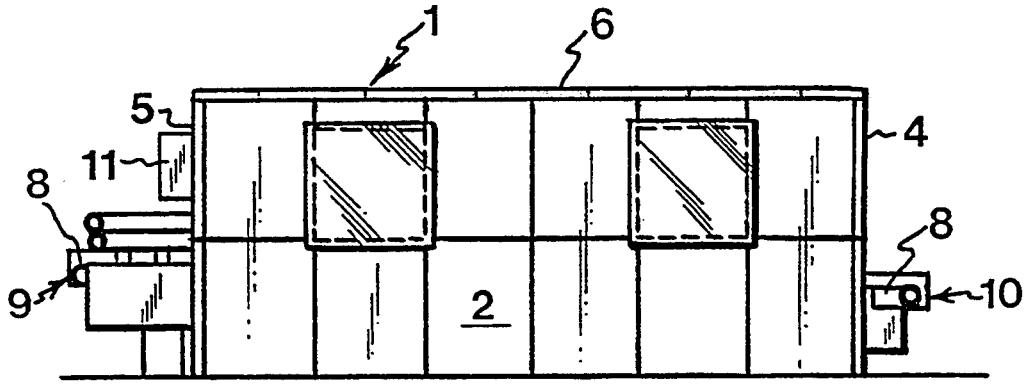
FIG. 1 is a schematic side view.
Figure 2:
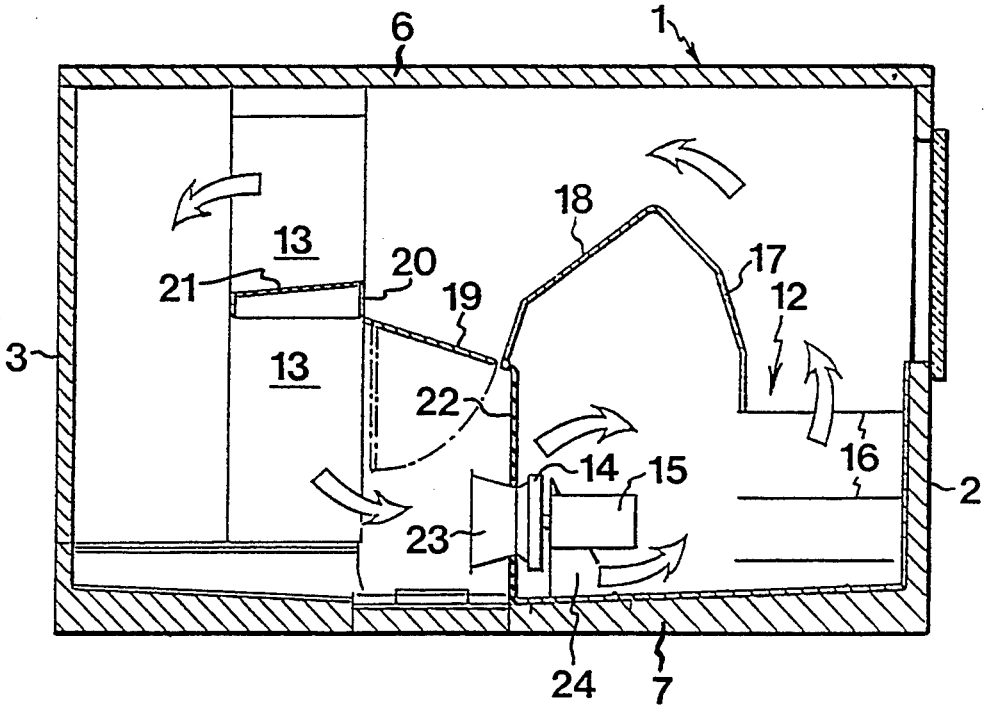
FIG. 2 is a cross-sectional view of a freezing plant according to the present invention.
Figure 3:
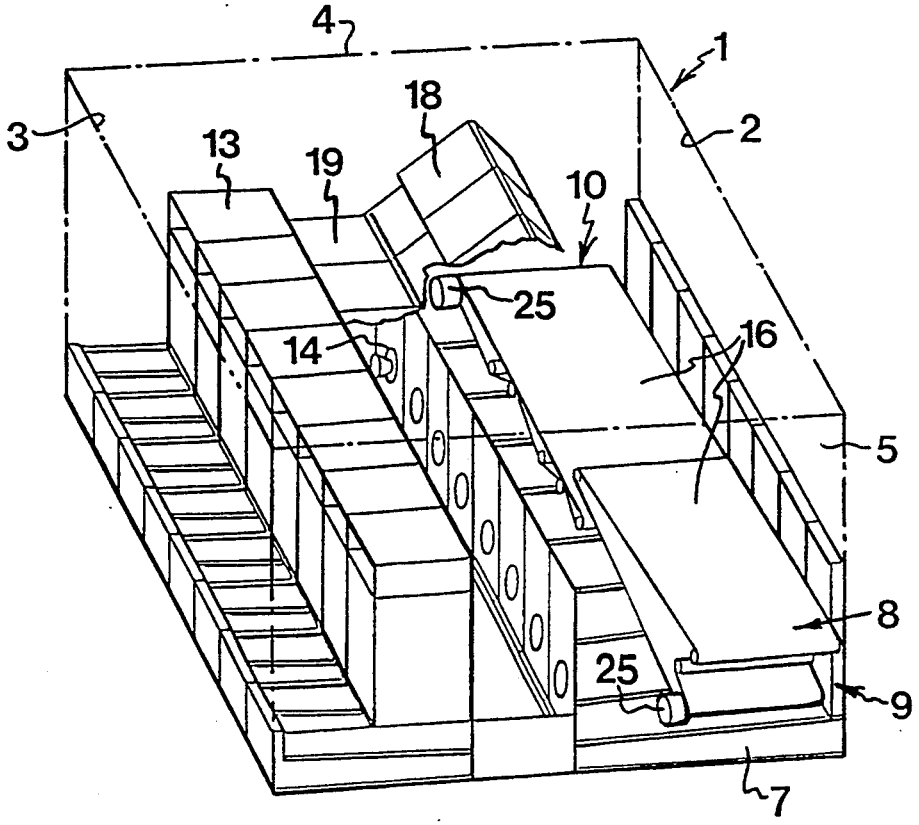
FIG. 3 is a perspective view of the units accommodated in the freezing plant in FIGS. 1 and 2.

The embodiment of a freezing plant according to the invention as shown in FIGS. 1–3 has a housing 1 with side walls 2 and 3, end walls 4 and 5, a roof 6 and a bottom 7. The end walls 4 and 5 have openings for a belt conveyor 8 traversing the housing 1 and having an infeed station 9 and an outfeed station 10. Also, the end wall 5 of the housing 1 is provided with a control unit 11 for the belt conveyor 8.

The housing 1 is divided into a number of substantially identical modules extending transversely of the longitudinal direction of the belt conveyor 8, as disclosed more specifically in Swedish Patent Application No. 9102861-3.

As shown in FIGS. 2 and 3, the housing accommodates a trough 12, a cooling-coil battery unit 13 and a fan 14 with a fan motor 15. The bottom of the trough 12 is formed by the two, foraminated conveyor belts 16 of the belt conveyor 8. The outer side wall of the trough 12 is formed by the side wall 2 of the housing 1. The inner side wall 17 of the trough 12 extends vertically upwards from the belt 16 and is then angled to form an air duct expanding over the bed. The air duct is defined between the inner side of the housing 1 and a boundary wall 18 connecting to the side wall 17, and further boundary wall 19–22. The boundary wass 22 has an opening for a suction part 23 of the fan 14, which together with the motor 15 is mounted on the bottom 7 of the housing 1 by means of an angle attachment 24.

The fan assembly of the freezing plant consists of several fans 14 mounted throughout the length of the trough 12 and each having a motor 15. Similarly, the cooling-coil battery of the freezing plant consists of several cooling-coil battery units 13 disposed throughout the length of the trough 12.

By the design described above, the fan assembly 14 in each module produces an air flow according to the arrow in FIG. 2, i.e. a closed path through the cooling-coil battery unit 13, the fan assembly 14, up through the trough 12 and back to the cooling-coil battery unit 13.

The infeed station 9 comprises in conventional manner a device for cleaning the belt 16. The belt cleaning device operates by means of air jets, liquid jets or a mechanical scraping action for removing layers of foodstuff residues and/or ice which have built up on the belt.

The conveyor belts 16 are driven by electric motors 25 arranged in the infeed and outfeed stations 9 and 10, respectively. Although the belt conveyor 8, as illustrated, has two conveyor belts 16, it may of course comprise a single conveyor belt or more than two conveyor belts. According to the invention, the control unit 11 is arranged for at least periodically driving the front conveyor belt 16 in a direction opposite to the throughfeed direction of the foodstuff in the trough 12 to the device for cleaning. By such driving, the portion of this belt 16 that is located nearest the infeed station 9 and below the bed of foodstuff in the trough 12 will be periodically moved out to the cleaning device of the infeed station 9 for removal of layers on conveyor belt (16). The build-up of foodstuff residues and ice on the conveyor belt which primarily takes place at the end of trough 12 adjacent the infeed station 9 can thus be easily removed.

The control unit 11 may be arranged for continuously driving the front conveyor belt 16 in a direction opposite to the throughfeed direction of the foodstuff in the trough 12. This mode of operation is primarily usable in the event the air flow through the trough 12 is sufficient for maintaining a fluidised state therein, the fluidisation bringing about the throughfeed of foodstuff in the trough 12. In the illustrated embodiment with two conveyor belts 16, these can be controlled independently of each other.

Alternatively, the control unit may be arranged for periodically driving the front belt 16 in opposite directions about a fixed position. Although in this case only that part of the conveyor belt 16 which is periodically moved into the cleaning device will be kept free of the build-up of layers of material, the oscillating motion which the belt then executes will facilitate the agitation or fluidisation of the foodstuff particles in the trough 12.

According to another alternative, it is conceivable to arrange the control unit 11 for periodically driving the belt 16 in oposite directions with a net motion in the throughfeed direction of the foodstuff in the trough.

For ensuring the above-mentioned driving of the front conveyor belt 16, the electric motor or electric motors 25 are suitably stepping motors.

In addition to the conveyor belts 16, the bottom of the trough 12 may include a fixed, foraminated plate disposed underneath the conveyor belts. In its preferred embodiment, the bottom of the trough 12 however consists only of the foraminated conveyor belts 16.

Figure 4:
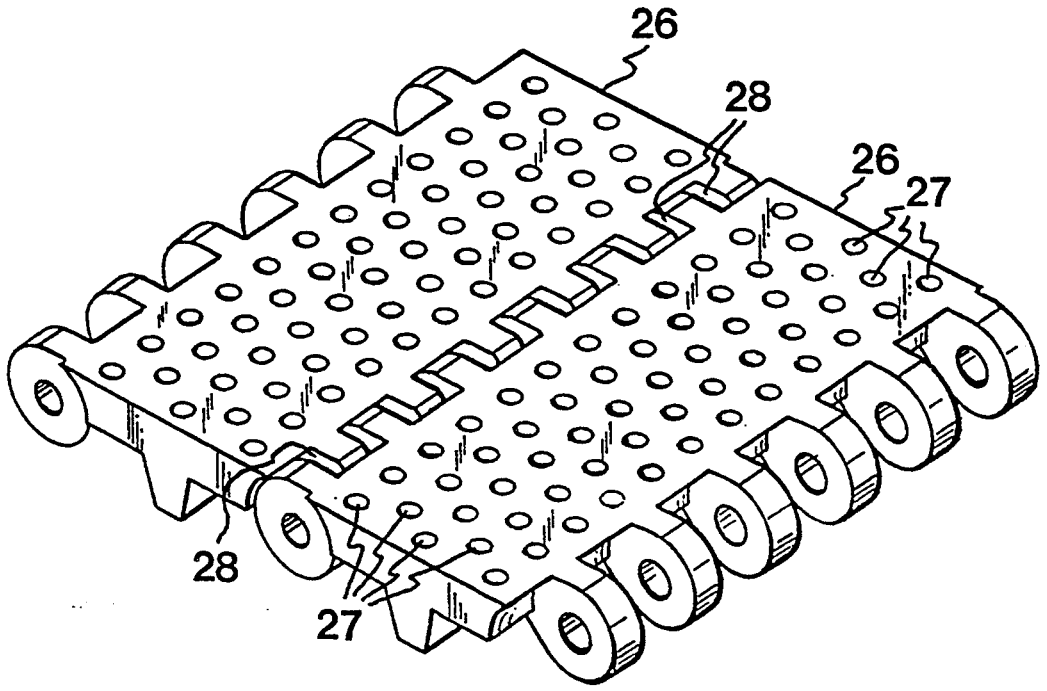
FIG. 4 shows parts of a foraminated conveyor belt usable in the freezing plant of the invention.

The conveyor belts 16 preferably are of the type illustrated in FIG. 4. This Figure shows more specifically two identical plates 26 which can be linked together in an optional number, both longitudinally and transversely, to form a conveyor belt 16 of desired length and width. According to the invention, the plates 26 have perforations in the form of through holes 27 over their entire surface, as well as slots 28 along the articulated joint used for linking together the plates in the longitudinal direction of the belt 16. With a belt of the design as partially shown in FIG. 4, it is possible by the thickness of the plates 26 to provide perforations 27, 28 which make it possible to accurately guide the air flow through the bottom, in the form of the belts 16, of the trough 12, and thus ensure a stable fluidising state.

It is understood that the invention is not restricted to the particular embodiment of a freezing plant as described above, but can be modified within the scope of the accompanying claims. Thus, the invention is applicable to air treatment plants in general, and is not restricted to freezing plants.

I claim:

1. Air treatment plant for foodstuffs, comprising a housing (1), an elongate trough (12) provided therein for receiving the foodstuff to be treated, a heat exchanger (13) a fan assembly (14) for producing an air flow circulating through the heat exchanger, up through the trough and back to the heat exchanger, the bottom of the trough comprising a foraminated conveyor belt (16), wherein the conveyor belt (16) is driven by a motor (25) provided with a control unit (11) for at least periodically driving the conveyor belt in a direction opposite to a throughfeed direction of the foodstuff in the trough (12), a device for removing on the infeed side of the trough (12) layers of material which have built up on the conveyor belt (16) when the conveyor belt is being driven in the direction opposite to the throughfeed direction.

2. Air treatment plant as claimed in claim 1, wherein the control unit (11) is arranged for periodically driving the belt (16) in opposite directions about a fixed position.

3. Air treatment plant as claimed in claim 2, characterised in that the motor (25) is a step motor.

4. Air treatment plant as claimed in claim 3, characterised in that the bottom of the trough (12) further comprises a fixed, foraminated plate disposed underneath the conveyor belt (16).

5. Air treatment plant as claimed in claim 1, wherein the control unit (11) is arranged for periodically driving the belt (16) in opposite directions with a net motion in the throughfeed direction of the foodstuff in the trough (12).

6. Air treatment plant as claimed in claim 5, characterised in that the motor (25) is a step motor.

7. Air treatment plant as claimed in claim 6, characterised in that the bottom of the trough (12) further comprises a fixed, foraminated plate disposed underneath the conveyor belt (16).

8. Air treatment plant as claimed in claim 1, wherein the control unit (11) is arranged for continuously driving the conveyor belt (16) in a direction opposite to the throughfeed direction of the foodstuff in the trough (12).

9. Air treatment plant as claimed in claim 8, characterised in that the bottom of the trough (12) consists only of one or more foraminated conveyor belts.

10. Air treatment plant as claimed in claim 9, characterised in that the foraminated conveyor belt or belts (16) consist of plates (26) which are articulated to each other and have perforations over their entire surface in the form of through holes (27), as well as through slots (28) at their portions of articulation.

11. Air treatment plant as claimed in claim 1, wherein the motor (25) is a stepping motor.

12. Air treatment plant as claimed in claim 1, wherein the bottom of the trough (12) further comprises a fixed, foraminated plate disposed underneath the conveyor belt (16).

13. Air treatment plant as claimed in claim 1, wherein the bottom of the trough (12) consists only of one or more foraminated conveyor belts (16).

14. Air treatment plant as claimed in claim 13, wherein the foraminated conveyor belt or belts (16) consist of plates (26) which are articulated to each other and have perforations over their entire surface in the form of through holes (27), as well as through slots (28) at their portions of articulation.

15. Air treatment plant as claimed in claim 1, wherein it is a freezing plant.

16. Air treatment plant as claimed in claim 1, characterised in that the motor (25) is a step motor.

17. Air treatment plant as claimed in claim 1, characterised in that the bottom of the trough (12) further comprises a fixed, foraminated plate disposed underneath the conveyor belt (16).

18. Air treatment plant as claimed in claim 17, characterised in that the bottom of the trough (12) consists only of one or more foraminated conveyor belts.

19. Air treatment plant as claimed in claim 1, wherein said device de-ices said conveyor belt (16).

* * * * *